United States Patent [19]

Schonberger

[11] 4,200,970

[45] May 6, 1980

[54] METHOD OF ADJUSTING RESISTANCE OF A THERMISTOR

[76] Inventor: Milton Schonberger, 195 Fern St., Westwood, N.J. 07885

[21] Appl. No.: 787,422

[22] Filed: Apr. 14, 1977

[51] Int. Cl.[2] ..... H01C 7/04

[52] U.S. Cl. ..... 29/593; 29/612; 338/195

[58] Field of Search ..... 29/593, 612, 574; 338/195, 22 SD

[56] References Cited

U.S. PATENT DOCUMENTS

| | | | |
|---|---|---|---|
| 2,693,023 | 11/1954 | Kerridge et al. | 338/195 X |
| 3,402,448 | 9/1968 | Heath | 29/593 X |
| 3,422,386 | 1/1969 | Helgeland | 29/593 X |
| 3,548,492 | 12/1970 | Weber | 29/593 X |
| 3,657,692 | 4/1972 | Wormser | 338/195 X |
| 3,827,142 | 8/1974 | Bennett et al. | 219/121 LM |
| 3,936,789 | 2/1976 | Matzen et al. | 338/22 SD |

*Primary Examiner*—Milton S. Mehr

*Attorney, Agent, or Firm*—Ostrolenk, Faber, Gerb & Soffen

[57] ABSTRACT

A wafer thermistor with opposite, generally flat surfaces has two spaced apart contacts on one surface and a third contact on the opposite surface; the third contact is considerably larger in surface area than the two contacts on the one surface; the conductors leading to the thermistor are connected to the two contacts on the one surface; to change the resistance of the thermistor, removal of a larger percentage of the surface area of one of the contacts will change the resistance of the thermistor by only a fraction of the surface area of the contact that was removed.

38 Claims, 9 Drawing Figures

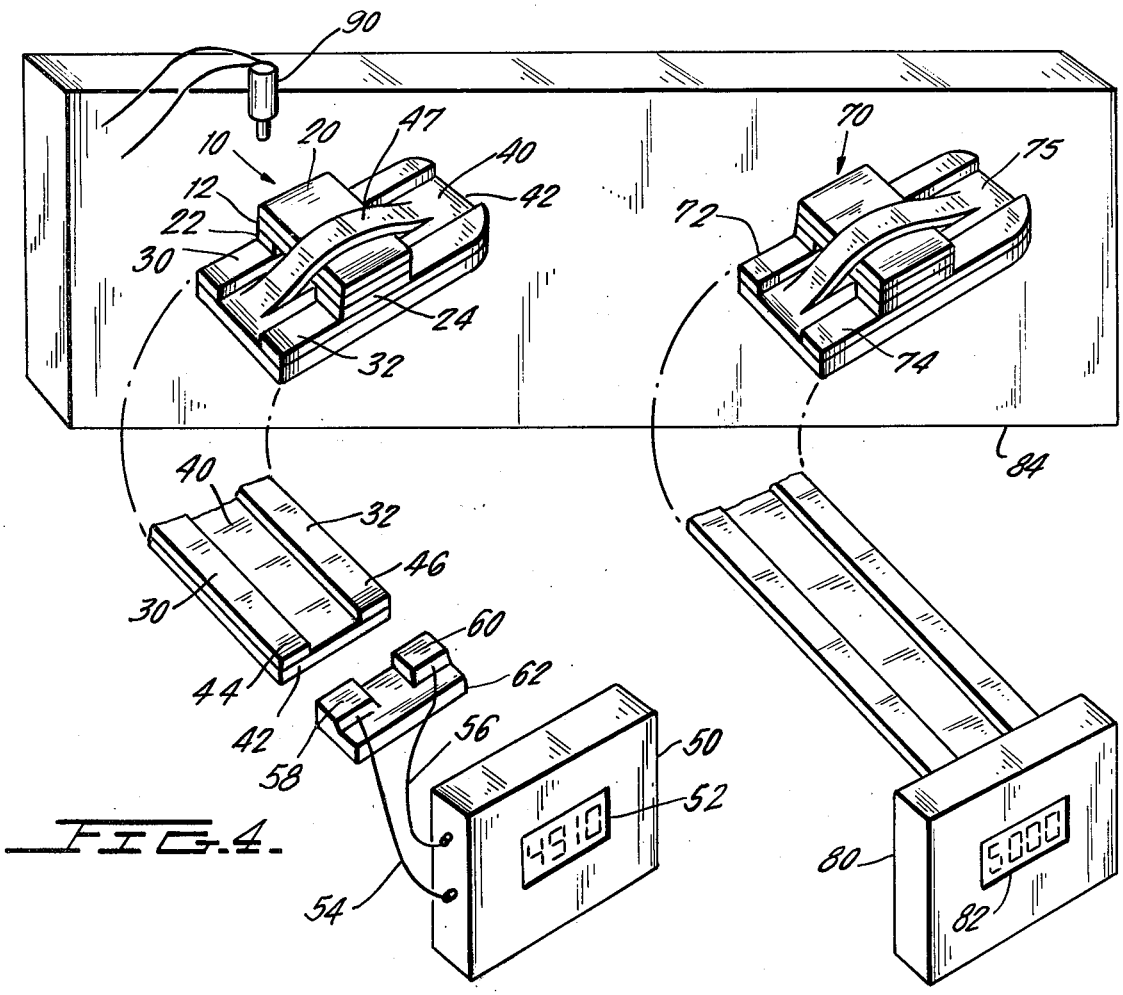
FIG. 4.
FIG. 7.
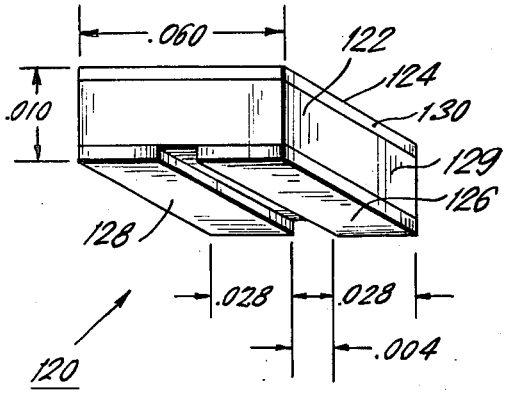
FIG. 7a.
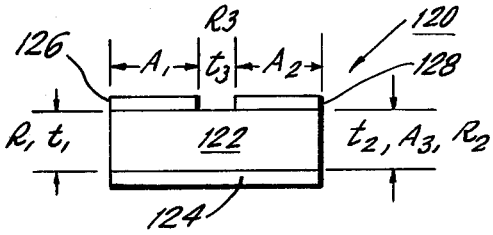
FIG. 7b.
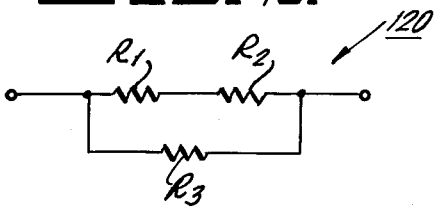

METHOD OF ADJUSTING RESISTANCE OF A THERMISTOR

FIELD OF THE INVENTION

The present invention relates to thermistors, and more particularly to thermistors having trimmable contacts and to a method of adjusting the resistance of a thermistor by trimming its contacts.

BACKGROUND OF THE INVENTION

A thermistor is a semiconductor usually of a ceramic like material and comprised of a metallic oxide. Typically, the ceramic thermistor body is formed of a sintered mixture of manganese oxide, nickel oxide, ferric oxide, magnesium chromate or zinc chromate, or the like. A thermistor makes use of the resistive properties of semiconductors. Thermistors have a large negative temperature coefficient of resistivity such that as temperature increases, the resistance of the thermistor decreases.

A thermistor is connected into an electric circuit which utilizes the resistance of the thermistor in some manner. For effecting an electric connection to the thermistor, the thermistor has contacts attached to it. The contacts may take various forms, including contact areas or buttons on the surface of the thermistor, or bared metal conductors which pass through the thermistor and contact its ceramic material, including conductors soldered or otherwise affixed to the body of the thermistor, etc. The contacts of the thermistor are, in turn, connected by conductors to other circuit elements.

The ceramic bodies of thermistors are formed in many ways. One typical thermistor is in bead form, somewhat rounded in shape. It may be molded in that form or cut from a rod, etc. Another typical thermistor is in a wafer form and is multi-sided. The wafer usually is six sided and has two large area opposite surfaces and four narrower width peripheral sides defining the large opposite surfaces. A wafer thermistor may, for example, be cut from a larger sheet or other body of thermistor material or it may be molded. The ceramic material of the thermistor may be formed or cut in virtually any size. Various techniques for cutting, grinding or otherwise trimming thermistor bodies to a particular size are well known.

The resistance of a thermistor is in part determined by the volume of the semiconductor material of which it is comprised. As the thickness of the semiconductor material between the contacts in a particular thermistor is reduced, the resistance of the thermistor increases. More significant, however, is the observation that the smaller the thickness of the thermistor material, the greater is its response, in terms of change in its resistance, for any particular change in the temperature to which the thermistor is exposed. Thus, in a situation where very accurate rating of a thermistor is desired, it is beneficial to make the thickness of the element of semiconductor material in the thermistor as small as possible. This has led to production of small size bead or wafer thermistors, with a typical wafer thermistor having a semiconductor material thickness dimension of approximately 0.010 mm. and the semiconductor material having its larger surfaces with dimensions of 0.060 mm.×0.060 mm.

One method of adjusting the resistance of the thermistor is by removing some of the semiconductor material between the thermistor contacts. Typically, however, the semiconductor material portions of the thermistor are mass produced in a uniform manner and removal of part of the semiconductor material of individual thermistors is difficult to accurately control without the expenditure of excessive amounts of time.

Another factor that determines the resistance of a thermistor is the surface area of the electric contacts of the thermistor which engage the conductors leading to the thermistor. It is the surface area of the contacts in actual contact with the semiconductor material of the thermistor that is important. Generally, the resistance of a thermistor, at constant temperature and pressure conditions, can be expressed by the formula $R=\rho t/A$, wherein $\rho$ is the resistivity of the semiconductor material, t is the thickness dimension of the semiconductor material along the shortest distance between its two contacts and A is the surface area of contact material or of semiconductor material (depending upon the arrangement of the contacts) which is actually involved in the passage of current through the thermistor. (This is explained in fuller detail below in the detailed description.)

Where the contacts of the thermistor are comprised of bared sections of the conductors that pass through the thermistor, the surface areas of the thermistor contacts in actual engagement with the surface of the thermistor material is predetermined and invariable and essentially inaccessible for being changed. Hence, the resistance of this type of thermistor cannot be adjusted by changing the surface areas of the contacts on the thermistor semiconductor material.

In a thermistor wherein the metallic electric contacts are applied to the exterior of the semiconductor material, then the resistance of the thermistor can be adjusted by trimming away some of the surface area of the contacts of the thermistor from the semi-conductor material of the thermistor. It has been found that on a thermistor having only two metallic contacts, of silver or copper, for example, and wherein each contact is connected to a respective electric conductor in a circuit and the contacts are on opposite surfaces of the thermistor, that if the surface area on the semiconductor material of one or both contacts is trimmed by a particular percentage, then the resistance of the thermistor increases by the maximum percentage reduction of the surface area of one of the contcts. (Again, this is explained in greater detail below.) For example, if the surface area of at least one of the two contacts is reduced by 4%, then the resistance of the thermistor increases by 4%, i.e. it has a resistance of 4% more ohms than prior to the trimming. For example, a thermistor rated at 5,000 ohms will, after the trimming described just above, be rated at 5,200 ohms.

As noted above, thermistors are typically quite small in size. The surface area of their contacts on the surface of the semiconductor material of the thermistor is also small. Precise trimming of, for example, 1% or a fraction of a percent of the material of a thermistor contact is difficult.

Various techniques of trimming the contacts of thermistors are known. Obviously, a contact can be filed, sanded or otherwise ground away. Thermistors are so small and the change in their resistance that may be required is sometimes so small that rubbing a thermistor contact lightly once on a slightly roughened surface may trim off enough of the contact to change the rating of the thermistor to the desired extent. Manual or rubbing techniques for trimming thermistor contacts, as just described, are time consuming and can make thermistor manufacture and resistance rating quite expensive. There has, therefore, developed in combination with fine grinding or as an alternative thereto a technique of laser trimming, wherein a collimated laser beam is directed at a thermistor contact to burn away the desired amount of the contact.

Any technique of trimming a thermistor contact, e.g. fine grounding, laser trimming etc. operates within certain tolerance limits, whereby it is possible that a particular trimming procedure may trim slightly too little or too much of a contact, with an undesired discrepancy between the desired and actual resistance of a particular thermistor. A technique which permits trimming of a greater percentage of the surface area of a thermistor contact to bring about a relatively lesser percentage of change in the resistance of a thermistor would be desirable. With such a method, a slight error in the extent to which a thermistor contact is trimmed or the tolerances that trimming necessarily must be within will have a smaller effect on the final rating of the thermistor than they have with presently used trimming techniques.

I have been informed, although I have never seen the item, that there have been thermistors which simultaneously have two different resistance ratings. These thermistors have three contacts applied to their surfaces, rather than two. The third contact typically is considerably larger than the other two. If a wafer type thermistor, the two smaller contacts share one surface of the semiconductor material and the third contact covers virtually the entirety of another surface of the semiconductor material. Such a thermistor simultaneously has two different resistance ratings, depending upon which two of the three thermistor contacts are connected to the conductors of an electric circuit. If the conductors are attached to the two smaller size contacts on the one surface of the thermistor, the thermistor will have one resistance rating. If the conductors are instead connected to one of the two contacts on the one surface of the thermistor and to the larger size contact on the opposite surface of the thermistor, the thermistor will have a different resistance rating. This phenomenon occurs because the change in connection of the contacts changes the total surface area of the contacts and the width of the gap between the contacts, i.e. the thickness of the semiconductor material.

The applicability of three contact thermistors to more precise resistance rating of thermistors are not heretofore been recognized.

Obviously, when any of the factors affecting thermistor resistance change, then the resistance of the thermistor changes.

SUMMARY OF THE INVENTION

Accordingly, it is the primary object of the present invention to provide a method for accurately rating a thermistor.

It is another object of the present invention to provide such a method wherein a relatively larger portion of the surface area of a thermistor contact can be trimmed to produce a relatively smaller change in the resistance of the thermistor.

It is a further object of the invention to accomplish the foregoing with small size thermistors.

It is another object of the invention to quite accurately trim a thermistor contact.

The foregoing objects are realized according to the present invention. The semiconductor body of a thermistor is formed in the usual manner. It is preferred that the invention be practiced with a wafer thermistor having at least two opposite, flat surfaces, although the invention is not limited to this shape thermistor.

Typically, the thermistor contacts are comprised of metal and may be comprised of silver mixed with glass particles called "frit". The contacts are baked or heat fused on to the flat surfaces of the thermistor semiconductor material. Preferably, the attached contact material covers the entirety of both opposite surfaces, although the material can cover any area less than the entirety of any surface.

One of the flat surfaces of the thermistor carries two separated contacts which together preferably cover their entire surface, although they also can cover any area less than the entire surface. A clear space between the two contacts can be formed, for example, by filing or grinding a space between the two contacts on the surface or by shining a laser beam along that surface of the thermistor to trim a gap through the contact material on the surface to define two contacts. It is not necessary that these two contacts be equal in size, nor is it necessary that they together extend across the entire respective surface of the thermistor.

A single contact fills the opposite flat surface of the thermistor.

Each of the two conductors leading to the thermistor is attached to a respective one of the thermistor contacts on the surface of the thermistor carrying two contacts. The conductors can be attached to the thermistor contacts in any manner. They can be held by an adhesive or they can be soldered, for example. They can be attached before the single layer of contact material on the surface carrying the two contacts is treated to define the two contacts on that one surface, or they can be attached afterward.

The technique of adjusting the resistance of the thermistor is now described. According to the mathematical formula considered in greater detail below, removal of X% of the surface area of any of the three contacts, but for practical manufacturing reasons, of the one contact that contacts the entirety of its surface of the thermistor, only increases the resistance of the thermistor by a fraction of X%. For example, in the preferred embodiment described below, if 10% of the surface area of one contact is removed, the resistance of the thermistor only increases by 1.8%. Obviously, if 11% of the surface area of the contact were to be inadvertently trimmed away, instead of 10%, this will have a much smaller effect upon the change in resistance of the thermistor than if the same 1% error were made in prior thermistor contact trimming techniques, where the 1% trimming error would produce a corresponding 1% change in the resistance of the thermistor.

A thermistor trimmed according to the invention may have use anywhere, including a thermometer shown in my copending application Ser. No. 779,152, filed Mar. 18, 1977.

Further understanding of the invention can be obtained from the following description of the accompanying drawings, in which:

FIG. 4 is a perspective, partially schematic view showing that thermistor mounted on a support and connected in a circuit and being rated;

FIGS. 5, 6 and 7 are views of different thermistor designs and

FIGS. 7*a* and 7*b* diagrammatically further depict the thermistor of FIG. 7 and all of these explain the reason why the invention works as it does.

DETAILED DESCRIPTION OF A PREFERRED EMBODIMENT

Figure 1:
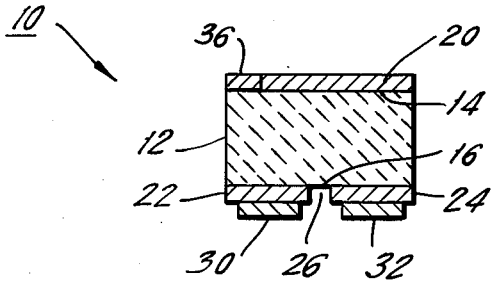
FIG. 1 is an end view of a thermistor according to the present invention.
Figure 2:
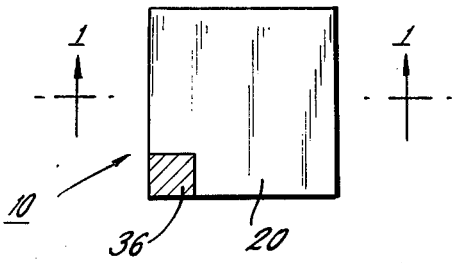
FIG. 2 is a top view of that thermistor, which has been trimmed.
Figure 3:
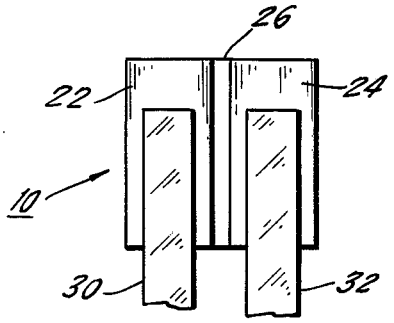
FIG. 3 is a bottom view of that thermistor.

The thermistor 10 shown in FIGS. 1–3 is comprised of a sintered, metal oxide, ceramic, semiconductor body 12 that is formed in the usual manner described above. The body 12 is a six sided wafer, with relatively larger size, equal surface area, opposite top and bottom surfaces 14 and 16. There is applied to the entirety of the upper surface 14 a metallic contact 20, whereby the surface area of the contact 20 on the semiconductor body 12 is equal to the entire surface area of the surface 14. The contact 20 is comprised of a mixture of silver and glass frit which are heat melted and then fused to the surface of the ceramic semiconductor material.

Beneath the undersurface 16 of the ceramic body 12 there are the individual contacts 22 and 24. These are comprised of the same material as contact 20. Originally, the contacts 22 and 24 were applied as a single layer covering the entire surface 16, in the same manner as the contact 20 was applied. However, in order to define the separate contacts 22, 24, the single layer on the bottom surface is cut, ground or filed to define the gap 26 at which no contact material is present. In order that the gap might be perhaps narrow and certainly of precise dimension, as required for accurate thermistor rating, the gap in the contact material could be formed by laser trimming through a laser beam simply burning away the gap between the contacts 22 and 24. Precision in the gap width is necessary so that the span of the resistances of the thermistor remain constant over the full range of temperatures to which the thermistor is exposed. The placement of the gap 26 is selected to make the contacts 22 and 24 generally equal in their respective surface area in contact with the ceramic body 12. But, such equality of surface area is not essential, as the formula for thermistor resistance, described below, will show.

The thermistor 10 is electrically connected to other objects by metal conductor 30 in secure contact with the contact 22 and by the other metal conductor 32 in secure contact with the contact 24. The conductors 30 and 32 join an object with which the thermistor cooperates in making a complete electric circuit.

The resistance of thermistor 10 is measured and found to be too small. According to the present invention, in order to raise the resistance of thermistor 10, part of the surface area of one of its contacts, but in this preferred embodiment, of its third contact 20, is removed. As noted above, this increases the resistance of the thermistor by only a fraction of the decrease in the surface area of this contact. As shown in FIGS. 1 and 2, a corner portion 36 of the contact 20 has been trimmed away, e.g. by laser trimming, by filing, grinding, etc. Measurement of the thermistor resistance shows that it is now at the proper resistance.

In modifications of the method, the contact 20 can occupy less than the entire area of the surface 14, the contacts 22, 24 on the surface 16 can be of different respective sizes, the surfaces 14 and 16 can be of different respective sizes and other variations in these contacts and the thermistor construction can be present.

One example of an embodiment which uses a thermistor is shown in my copending application covering a thermometer in which a thermistor is the temperature responsive component, U.S. application Ser. No. 779,152, filed Mar. 18, 1977. But any other circuit in which a thermistor would be needed is appropriate for connection to the conductors 30 and 32.

Referring to FIG. 4, one method of rating a thermistor and the apparatus used in rating the thermistor is illustrated. The thermistor 10 is adjusted in its resistance by trimming away part of the surface area of contact 20, which raises its resistance. There is no way to trim the contact 20 in a manner that reduces the resistance of the thermistor. Accordingly, the thermistor 10 is typically manufactured with its contact 20 covering a slightly greater surface area than it should cover for a particular desired resistance rating. Then the contact 20 is always trimmed to obtain a proper rating.

The thermistor 10 should have a particular resistance rating under certain standard temperature, humidity and other ambient conditions. The resistance of the thermistor is measured against a known standard resistance and the thermistor contact 20 is trimmed so that the resistance of thermistor 10 will bear a predetermined relationship to the known resistance standard under standard conditions of measurement, e.g. the resistance of the thermistor will match that of the known resistance standard.

The thermistor 10 is seated on the conductors 30, 32 in the manner shown in FIG. 1. The conductors are metal foil strips that are coated on or otherwise affixed to an elongated non-conductive supporting substrate 40. The substrate and the conductors 30, 32 extend to the end 42 of the substrate. The conductor end portions 44, 46 comprise plug-in terminals. The upper surface of the metal foil conductors are tinned with a solder layer for enabling affixation of the contacts 22, 24.

The substrate 40 is cut to define a strap 47 intermediate the conductors 30, 32. The strap is deformed, i.e. raised, to define a space between the strap and the rest of the substrate. The thermistor 10 is slipped into the space under the strap, with the contacts 22, 24 seated on their respective conductors 30, 32, and the strap is released. The substrate is comprised of a flexible plastic material having a "memory", such as Mylar, and the strap seeks to return to its original condition, thereby securely holding the thermistor in place.

Heat is applied to the thermistor at a level sufficient to melt the solder so as to both mechanically and electrically secure the contacts 22, 24 to the conductors 30, 32, respectively. The solder has a melting point low enough such that the thermistor is not permanently damaged by the heat that solders it to the conductors. Optionally, a sheath (not shown) may be drawn over or placed around the thermistor, the substrate and the conductors to protect them.

The gap 26 between the contacts 22, 24 can be formed before the thermistor 10 is applied on the conductors 30, 32. The entire substrate 40 provides a convenient means for holding the thermistor in place and for handling it. A thermistor is quite small and it is desirable to have an effective means for holding it in place while it is being worked on. Thus, it is contemplated that the formation of the gap 26 may occur after the thermistor has been mounted on the substrate, e.g. by directing a laser beam longitudinally down the center of the substrate 40 at the level of the metal layer of which the contacts 22, 24 are formed.

A first potentiometer 50, of any conventional variety is provided. It must be capable of measuring the resistance of an object electrically connected to it. The potentiometer 50 digitally displays the resistance of an object electrically connected to it on the digital display 52. The leads 54, 56 from the potentiometer are connected to the terminals 58, 60 inside the hollow socket 62. The opening into the socket 62 is shaped so as to securely receive both the substrate 40 and the conductor terminals 44, 46 and to cause electric engagement between the terminal conductors 44, 46 and the respective socket terminals 58, 60. A spring biasing means in the socket may additionally urge the engaging terminals together. In this manner, the thermistor 10 through its contacts 22, 24 are connected with the potentiometer 50. When the potentiometer is rendered operable, its digital display 52 reports the resistance of the thermistor 10.

In FIG. 4, the standard against which the thermistor 10 is rated comprises another identical wafer thermistor 70 whose resistance has been previously established at the precise rating to which the thermistor 10 is to be trimmed. The standard thermistor should be identical to the one being rated as changes in ambient conditions could affect different thermistors differently, whereas the identity of the two thermistors cancels out the effects of changes in the ambient conditions. The conductors 72, 74 on their supporting substrate 75 are connected to the same contacts of thermistor 70 and are also connected to a second conventional potentiometer 80 with its own digital display 82 which displays the resistance of the thermistor 70.

The thermistor 10 and the standard against which it is being rated, i.e. the thermistor 70, are placed in the chamber 84. The principal significant characteristic of chamber 84 is that all conditions of temperature, pressure, humidity, air quality, etc. are the same for both of the thermistors 10 and 70.

In the example illustrated in FIG. 4, before trimming, the thermistor 10 is rated at 4,910 ohms whereas the thermistor 70 is rated at 5,000 ohms, i.e. the resistance of the thermistor 10 is 1.8% less than the resistance of the thermistor 70.

In accordance with any of the techniques described above, the thermistor contact 20 on thermistor 10 is now trimmed to remove some of the surface area of the contact, e.g. by forming the cutout section 36 shown in FIGS. 1 and 2. To raise the resistance of thermistor 10 by approximately 1.8% to 5,000 ohms, 10% of the surface area of the thermistor conductor 20 is trimmed away. A laser tube 90 is supported inside chamber 84 and is positioned to have its collimated light beam directed at a corner of the contact 20. To trim the contact, the laser is activated and the laser tube 90 is then moved so that the laser beam burns away just the amount of contact material needed to properly rate the thermistor.

As a practical matter, precise measurement of the surface area of the contact 20 and of the portion thereof being removed is not necessary. The resistances of the thermistors 10 and 70 can be continuously monitored, while the surface area of the contact 20 is being trimmed, until the measured resistance of the two thermistors 10 and 70 match.

Contact trimming, at least in part relying upon abrasion or laser trimming, may slightly raise the temperature of the thermistor 10. The temperature rise is minimal, and after the trimming is completed, the thermistor temperature will quickly return to that in chamber 84. With laser trimming, there is at most a negligible change in temperature of thermistor 10. Typically, after a very few seconds, the resistance reading on the readout 52 will settle to a constant level.

Upon empirically observing the above phenomenon, concerning trimming of a thermistor contact, I sought advice as to the theoretical basis for the observed change in the resistance of a thermistor. I accordingly learned the following explanation, which should be read in conjunction with FIGS. 5–7.

Figure 5:
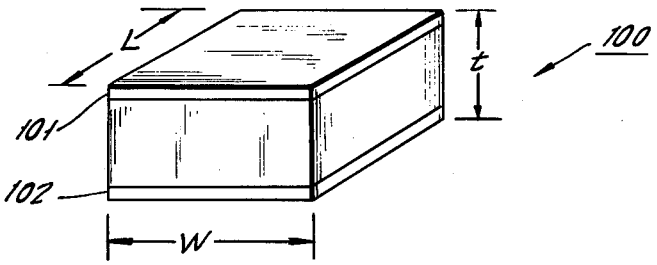

FIG. 5 shows one conventional two contact thermistor 100 having equal surface area contacts 101 and 102 on its top and bottom surfaces, respectively. This thermistor has the construction of and operates like a capacitor. The resistance of the thermistor 100 is computed according to the formula:

$$R=(\rho t/A),$$

wherein, at standard temperature (25° C.) and pressure (1 Atmosphere), R is the resistance, $\rho$ is the resistivity of the sermiconductor material (a characteristic of the particular material at a particular temperature and pressure), t is the thickness of the thermistor, i.e. the gap length between contacts 101 and 102 and A is the surface area of the overlapping contact area of the contacts 101 and 102. The overlapping contact area is that contact area where a straight line would be perpendicular to both contacts. In FIG. 5 both contacts 101 and 102 have the same surface and they are above one another, whereby $A=LW$. If 10%, for example, of its surface area were trimmed from contact 102, the contacts 101, 102 would overlap over only 90% of the surface area of contact 104 and the basic formula shows that the resistance of thermistor 100 would decrease by 10%. Obviously, the same change would occur if both contacts 101 and 102 were reduced by 10% of their surface areas.

Figure 6:
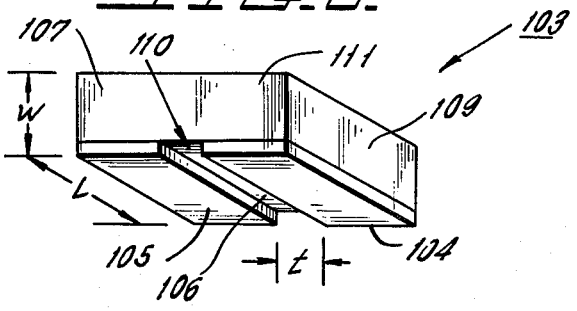

FIG. 6 illustrates a different type of wafer thermistor 103, which has its two contacts 104 and 105 on the same surface 106 of the wafer body 107 of semiconductor material. In the case of a thin wafer 107 of semiconductor material, the same basic formula applies: $R=\rho t/A$. But, as shown in FIG. 6, with a thin wafer, A is the area of the thickness dimension of body 107 along the side 109 having a contact 105 extending along its margin and t is the width of the gap 110 between contacts 104 and 105. A is dependent upon the length L of contacts 104, 105 along the side 109 in that only the L over which the contacts extend is considered in A. If one contact 104, 105, has a shorter L than the other, it is the shorter L that enters into the computation of A. Note that the relative widths of the contacts 104 and 105 have no effect on R, whereby, as discussed above, great care is not needed in placing the gap 110, although control of its width is more important.

To change the resistance of the thermistor 103, the length L of one or both of the contacts 104, 105 is trimmed. According to the formula, if L is reduced by 10%, R correspondingly increases by 10%.

FIG. 7 shows a thermistor 120 of the type used with the invention. It includes the element 122 of semiconductor material, the contact 124 over the entirety of one surface and the two gap separated contacts 126, 128 on the opposite surface. The numerical dimensions shown in FIG. 7 cover one example of this thermistor.

FIG. 7*a* shows that in the thermistor 120 there are three different Rs and ts, between the three different pair combinations of contacts. FIG. 7*b* shows that the Rs of thermistor 120 are, in effect, $R_1$, and $R_2$ resistances in series with $R_3$ resistance connected in parallel across $R_1$ and $R_2$. The resistance of thermistor 120 may be computed in the following manner:

$$R_1=\rho t_1/A_1=1000\ (0.010)/0.028(0.060)=5950$$

wherein $A_1$ is the smallest LxW over which the contacts 124, 126 overlap (as defined previously) and $\rho$ is a constant for the particular semiconductor material at standard temperature and pressure.

$$R_2=\rho t_2/A_2=1000\ (0.010)/0.028(0.060)=5950,$$

wherein $A_2$ is the smallest $L\times W$ over which the contacts 124, 128 overlap.

$$R_3=\rho t_3/A_3=1000\ (0.004)/0.010(0.060)=6670,$$

wherein $A_3$ is the area of surface 129 (as discussed in connection with FIG. 6).

The resistance of the circuit shown in FIG. 7*b* is:

$$R_{total}=\frac{(R_1+R_2)R_3}{R_1+R_2+R_3}=\frac{(11.9)6.67}{18.57}=4{,}270\text{ ohms}$$

When 10% of the surface area of contact 124 is removed from thermistor 120, e.g. by trimming off the edge 130, then $R_2$ is changed. Such trimming of contact 124 can be done by laser or other trimming off just the section of contact 124 or a whole side edge of the thermistor including the body of the semiconductor material, e.g. by grinding a wedge shaped section that includes contact 124 or by grinding a rectangular section including both of contacts 124 and 128. In any case, $A_2$ will decrease by 10% and, according to the formula $R_2=\rho t_2/A_2$, $R_2$ will increase by 10%. 110% of $R_2$ is our example is 6.545.

$R_{total}$ $_{(new)}=5.95+6.545(6.67)/5.95+6.545+6.67=4.349$ ohms The change from $R_{total}$ to $R_{total(new)}$ is 79 ohms. 79 ohms is 1.85% of the original 4270 ohms of thermistor 120, whereby a 10% change in the surface area of a contact of thermistor 120 only produces a 1.85% change in its resistance.

It is to be remembered that the foregoing formulas are premised upon use of a thin wafer of semiconductor material, and fringing is ignored. Fringing is losses due to thickness of the semiconductor material, and some of the lines of electromagnetic force straying from the direct path between the two contacts 126, 128.

In an actual experiment with a thermistor trimmed according to the invention there was an increase of 2% in resistance upon a 10% reduction in the area of contact 124. This discrepancy of 0.015% from the theoretical change in resistance is perhaps attributable to wafer thickness, fringing, variations from standard ambient conditions, etc. But, this discrepancy does not present any problem with thermistor rating according to a technique like that illustrated in FIG. 4 wherein the thermistor is rated as it is being continuously monitored.

Although the present invention has been described in connection with a preferred embodiment thereof, many variations and modifications will now become apparent to those skilled in the art. It is preferred,, therefore, that the present invention be limited not by the specific disclosure herein, but only by the appended claims.

I claim:

1. A method of adjusting the resistance of a thermistor, comprising:

forming a first and a second electric contact on one surface area of an element of thermistor semiconductor material;

forming a third electric contact on another surface area of the element of thermistor semiconductor material, the contacts being formed such that the one and the other surface areas overlapping such that the first and second electric contacts overlap the third electric contact;

and the element of thermistor semiconductor material and the first, second and third contacts together comprise a thermistor;

adjusting the resistance of the thermistor by trimming off part of at least one contact to reduce its area while keeping the one and the other surface areas overlapping such that the first and second electric contacts overlap the third electric contact after said trimming.

2. The method for adjusting the resistance of a thermistor of claim 1, further comprising applying a respective electric conductor to each of the first and second contacts.

3. The method for adjusting the resistance of a thermistor of claim 2, further comprising connecting the conductors to an electric meter which measures the resistance of the thermistor, and measuring the resistance of the thermistor;

comparing the measured resistance of the thermistor against a standard;

said step of trimming the contact comprises trimming that contact until the measured resistance of the thermistor bears a predetermined relationship to the standard.

4. The method for adjusting the resistance of a thermistor of claim 3, wherein the contact being trimmed is the third contact.

5. The method for adjusting the resistance of a thermistor of claim 1, wherein the one and the other surface areas of the element of thermistor semiconductor material are on opposite surfaces thereof.

6. The method for adjusting the resistance of a thermistor of claim 5, wherein the one and the other surface areas are approximately equal in size.

7. The method for adjusting the resistance of a thermistor of claim 6, wherein the step of forming the third contact comprises applying a layer of contact material over the entire other surface area of the element of thermistor semiconductor material.

8. The method for adjusting the resistance of a thermistor of claim 6, wherein the trimming of at least one contact adjusts the resistance of the thermistor according to the following formulation:

$$R_{total}=\frac{(R_1+R_2)R_3}{R_1+R_2+R_3}$$

wherein $R_{total}$ is the resistance of the thermistor; and $$R_1=\rho t_1/A_1,$$

wherein $A_1$ is the smallest area on the opposite surfaces of the thermistor over which one of the two contacts on the one surface area and the third contact on the opposite surface area overlap, $t_1$ is the thickness of the semiconductor thermistor material between the two overlapping contacts and $\rho$ is a constant for the particular semiconductor material;

$$R_2=\rho t_2/A_2$$

wherein $A_2$ is the smallest area on the opposite surfaces of the thermistor over which the other of the two contacts on the one surface area and the third contact on the opposite surface area overlap and $t_2$ is the thickness of the semiconductor thermistor material between the two overlapping contacts;

$$R_3=\rho t_3/A_3$$

wherein $A_3$ is the area of the side surface of the semiconductor thermistor material along a side of the thermistor along which only one of the two contacts extends for the full length of that contact and $t_3$ is the width of the gap between the two contacts on the one thermistor surface area.

9. The method for adjusting the resistance of a thermistor of claim 5, wherein the element of thermistor semiconductor material is in the shape and form of a wafer.

10. The method for adjusting the resistance of a thermistor of claim 1, wherein the step of forming the first and second contacts comprises applying a layer of contact material to the one surface area of the element of thermistor semiconductor material and then removing some of that layer of contact material from the one surface area at a location to define a gap completely through that layer of contact material, thereby to define the separated first and second contacts.

11. The method for adjusting the resistance of a thermistor of claim 10, wherein the layer of contact material is removed along a path extending completely across the one surface area so that the gap in that layer of contact material shapes the first and second contacts to be approximately equal in their respective surface areas of contact on the element.

12. The method for adjusting the resistance of a thermistor of claim 11, wherein the one and the other surface areas of the element of thermistor semiconductor material are on opposite surfaces thereof.

13. The method for adjusting the resistance of a thermistor of claim 12, wherein the one and the other surface areas are approximately equal in size.

14. The method for adjusting the resistance of a thermistor of claim 12, wherein the trimming is performed at a location on contact material selected so as to not adjust the width of the gap through the layer of contact material.

15. The method for adjusting the resistance of a thermistor of claim 10, wherein the trimming is performed at a location on contact material which is selected so as to not adjust the width of the gap through the layer of contact material.

16. The method for adjusting the resistance of a thermistor of claim 1, wherein the step of forming the third contact comprises applying a layer of contact material over the entire other surface area of the element of thermistor semiconductor material.

17. A method for adjusting the resistance of a thermistor comprising:

forming a first and a second electric contact on one of two opposite surface areas of an element of thermistor semiconductor material;

forming a third electric contact on the other of the two opposite surface areas of the element of thermistor semiconductor material, the contacts being formed such that both of the first and second electric contacts, on the one hand, overlap the third electric contact, on the other hand;

and the element of thermistor semiconductor material and the first, second and third contacts together comprise a thermistor;

applying a respective electric conductor to each of the first and second contacts;

connecting the conductors to an electric meter which measures the resistance of the thermistor, and measuring the resistance of the thermistor;

comparing the measured resistance of the thermistor against a standard;

adjusting the resistance of the thermistor to bear a predetermined relationship to the standard by changing the area of the overlapping surface areas of at least one of the first and second contacts, on the one hand, and of the third contact, on the other hand and such changing of the areas being such that the first and second electric contacts continue to overlap the third electric contact after said trimming.

18. The method for adjusting the resistance of a thermistor of claim 17, comprising the further step of applying the conductors to a supporting substrate, whereby the conductors and the thermistor are supported on the substrate.

19. The method for adjusting the resistance of a thermistor of claim 18, further comprising deforming the substrate to engage and hold the thermistor in place on the substrate.

20. The method for adjusting the resistance of a thermistor of claim 19, wherein the step of deforming the substrate comprises forming a strap of the substrate between the conductors thereon, deforming the strap to define a space for the thermistor between the strap and the rest of the substrate, and placing the thermistor in the space under the deformed strap.

21. The method for adjusting the resistance of a thermistor of claim 20, wherein the changing of the area of the overlapping surface areas comprises trimming off part of at least one contact to reduce its area; and the contact being trimmed is the third contact.

22. The method for adjusting the resistance of a thermistor of claim 18, comprising the further step of soldering the contacts to the respective conductors.

23. The method for adjusting the resistance of a thermistor of claim 17, comprising the further step of soldering the contacts to the respective conductors.

24. The method for adjusting the resistance of a thermistor of claim 17, wherein the trimming of at least one contact adjusts the resistance of the thermistor according to the following formulation:

$$R_{total} = \frac{(R_1 + R_2)R_3}{R_1 + R_2 + R_3}$$

wherein $R_{total}$ is the resistance of the thermistor; and $$R_1=\rho t_1/A_1,$$

wherein $A_1$ is the smallest area on the opposite surfaces of the thermistor over which one of the two contacts on the one surface area and the third contact on the opposite surface area overlap, $t_1$ is the thickness of the semiconductor thermistor material between the two overlapping contacts and $\rho$ is a constant for the particular semiconductor material;

$$R_2=\rho t_2/A_2$$

wherein $A_2$ is the smallest area on the opposite surfaces of the thermistor over which the other of the two contacts on the one surface area and the third contact on the opposite surface area overlap and $t_2$ is the thickness of the semiconductor thermistor material between the two overlapping contacts;

$$R_3=\rho t_3/A_3$$

wherein $A_3$ is the area of the side surface of the semiconductor thermistor material along a side of the thermistor along which only one of the two contacts extends for the full length of that contact and $t_3$ is the width of the gap between the two contacts on the one thermistor surface area.

25. The method for adjusting the resistance of a thermistor of claim 17, wherein the changing of the area of the overlapping surface areas comprises trimming off part of at least one contact to reduce its area.

26. The method for adjusting the resistance of a thermistor of claim 25, wherein the contact being trimmed is the third contact.

27. The method for adjusting the resistance of a thermistor of claim 25, wherein the step of trimming the contact comprises directing a laser beam at that contact to burn away part of the surface area of that contact.

28. The method for adjusting the resistance of a thermistor of claim 27, wherein the contact being trimmed is the third contact.

29. The method for adjusting the resistance of a thermistor of claim 25, wherein the step of forming the first and second contacts comprises applying a layer of contact material to the one surface area of the element of thermistor semiconductor material and then removing some of that layer of contact material from the one surface area at a location to define a gap completely through that layer of contact material, thereby to define the separated first and second contacts; and the trimming is performed at a location on contact material selected so as to not adjust the width of the gap through the layer of contact material.

30. A method for adjusting the resistance of a thermistor, wherein the thermistor comprises an element of thermistor semiconductor material, a first and a second contact on one surface area of the element of thermistor semiconductor material and a third electric contact on another surface area of the element of thermistor semiconductor material; the contacts being formed such that the one and the other surface areas overlapping such that the first and second electric contacts overlap the third electric contact;

the method comprising adjusting the resistance of the thermistor by changing the area of the overlapping surface areas of at least one of the first and second contacts, on the one hand, and of the third contact, on the other hand, and such changing of the areas being such that the first and second electric contacts continue to overlap the third electric contact after said trimming.

31. The method for adjusting the resistance of a thermistor of claim 30, wherein the changing of the area of the overlapping surface areas comprises trimming off part of at least one contact to reduce its area.

32. The method for adjusting the resistance of a thermistor of claim 31, further comprising applying a respective electric conductor to each of the first and second contacts;

connecting the conductors to an electric meter which measures the resistance of the thermistor, and measuring the resistance of the thermistor;

comparing the measured resistance of the thermistor against a standard;

adjusting the resistance of the thermistor to bear a predetermined relationship to the standard by trimming off part of the surface area of the contact.

33. The method for adjusting the resistance of a thermistor to claim 32, wherein the contact being trimmed is the third contact.

34. The method for adjusting the resistance of a thermistor of claim 32, wherein the one and the other surface areas of the element of thermistor semiconductor material are approximately equal in size and are on opposite surfaces of the element.

35. The method for adjusting the resistance of a thermistor of claim 34, wherein the element of thermistor semiconductor material is in the shape and form of a wafer.

36. The method for adjusting the resistance of a thermistor of claim 34, wherein the trimming of at least one contact adjusts the resistance of the thermistor according to the following formulation:

$$R_{total} = \frac{(R_1 + R_2)R_3}{R_1 + R_2 + R_3}$$

wherein $R_{total}$ is the resistance of the thermistor; and $$R_1=\rho t_1/A_1,$$

wherein $A_1$ is the smallest area on the opposite surfaces of the thermistor over which one of the two contacts on the one surface area and the third contact on the opposite surface area overlap, $t_1$ is the thickness of the semiconductor thermistor material between the two overlapping contacts and $\rho$ is a constant for the particular semiconductor material;

$$R_2=\rho t_2/A_2$$

wherein $A_2$ is the smallest area on the opposite surfaces of the thermistor over which the other of the two contacts on the one surface area and the third contact on the opposite surface area overlap and $t_2$ is the thickness of the semiconductor thermistor material between the two overlapping contacts;

$$R_3=\rho t_3/A_3$$

wherein $A_3$ is the area of the side surface of the semiconductor thermistor material along a side of the thermistor along which only one of the two contacts extends for the full length of that contact and $t_3$ is the width of the gap between the two contacts on the one thermistor surface area.

37. The method for adjusting the resistance of a thermistor of claim 30, comprising the initial step of forming an element of thermistor semiconductor material.

38. The method for adjusting the resistance of a thermistor of claim 37, wherein the element of thermistor semiconductor material is cut in the form of a wafer on which the one and the other surface areas are on opposite surfaces of that element.

* * * * *

UNITED STATES PATENT AND TRADEMARK OFFICE

CERTIFICATE OF CORRECTION

PATENT NO. : 4,200,970

DATED : May 6, 1980

INVENTOR(S) : Milton Schonberger

It is certified that error appears in the above-identified patent and that said Letters Patent are hereby corrected as shown below:

Add the following:

-- FOREIGN PATENT DOCUMENTS 522,660 6/1940 Great Britain..... --

Signed and Sealed this

*Nineteenth* Day of *August 1980*

[SEAL]

*Attest:*

SIDNEY A. DIAMOND

*Attesting Officer*

*Commissioner of Patents and Trademarks*